US007125014B2

(12) United States Patent
Dolz et al.

(10) Patent No.: US 7,125,014 B2
(45) Date of Patent: Oct. 24, 2006

(54) DEVICE FOR CONVEYING A STREAM OF SHEETS FROM A SHEET PILE TO A SHEET-PROCESSING MACHINE

(75) Inventors: Wolfgang Dolz, Heidelberg (DE); Andreas Jonas, Heidelberg (DE); Markus Möhringer, Weinheim (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 369 days.

(21) Appl. No.: 10/133,367

(22) Filed: Apr. 26, 2002

(65) Prior Publication Data

US 2002/0158410 A1 Oct. 31, 2002

(30) Foreign Application Priority Data

Apr. 26, 2001 (DE) ..... 101 20 951

(51) Int. Cl.
*B65H 29/32* (2006.01)

(52) U.S. Cl. ..... 271/197; 271/276

(58) Field of Classification Search ..... 271/194, 271/197, 196, 276
See application file for complete search history.

(56) References Cited

U.S. PATENT DOCUMENTS

| | | | | |
|---|---|---|---|---|
| 3,527,166 | A | 9/1970 | Jaffa et al. | |
| 3,827,548 | A | 8/1974 | Matsuo | |
| 4,447,817 | A * | 5/1984 | Naramore | 347/104 |
| 4,997,178 | A | 3/1991 | Ogoda | |
| 5,133,543 | A | 7/1992 | Eitel et al. | |
| 5,288,067 | A * | 2/1994 | Stock | 271/276 |
| 5,531,313 | A * | 7/1996 | Maass | 198/689.1 |
| 5,697,606 | A | 12/1997 | Maass | |
| 5,810,350 | A * | 9/1998 | Pollich | 271/276 |
| 5,833,231 | A * | 11/1998 | Schreiner | 271/197 |
| 2002/0060408 | A1 * | 5/2002 | Yraceburu et al. | 271/197 |

FOREIGN PATENT DOCUMENTS

| | | | |
|---|---|---|---|
| DE | 40 13 302 | A1 | 10/1991 |
| DE | 44 16 286 | C2 | 11/1995 |
| DE | 44 42 629 | C2 | 6/1996 |
| DE | 197 28 056 | A1 | 1/1999 |
| JP | 06135613 | A * | 5/1994 |

* cited by examiner

*Primary Examiner*—Gene O. Crawford
*Assistant Examiner*—Matthew J. Kohner
(74) *Attorney, Agent, or Firm*—Laurence A. Greenberg; Werner H. Stemer; Ralph E. Locher

(57) ABSTRACT

A device for conveying an imbricated stream of sheets from a sheet pile to a sheet-processing machine includes a conveying table provided with at least one revolvingly drivable, air-permeable conveyor belt. The belt has a top strand with an underside slidable over the conveying table, and a plurality of suction chambers arranged behind one another for subjecting the conveyor belt to negative pressure, so that the conveyed sheets are retained on the conveyor belt until they are transferrable to the sheet-processing machine. It further includes a common negative-pressure supply provided for negative-pressure activation of all of the suction chambers, and at least one throttle via which the suction chambers, respectively, are pneumatically connected to the common negative-pressure supply.

13 Claims, 5 Drawing Sheets

DEVICE FOR CONVEYING A STREAM OF SHEETS FROM A SHEET PILE TO A SHEET-PROCESSING MACHINE

BACKGROUND OF THE INVENTION

Field of the Invention

The invention relates to a device for conveying a stream of sheets, more particularly, an imbricated or overlapping stream, from a sheet pile to a sheet-processing machine.

The transport of sheets over a conveying table by a conveyor belt subjected to negative pressure may be subdivided into three phases:

1. After sheet separation or singling (at the sheet pile), the sheet is accepted by timed rollers (the timed rollers close). When the timed rollers are subsequently opened, the sheet is located only a short distance along the conveyor belt, but nevertheless, must already have to be retained thereon by an application of negative pressure.
2. During further transport to the sheet-feeding region, the sheet, due to the length of imbrication or overlap, can be retained over a clearly very large area.
3. Shortly prior to the arrival of the sheet at the front guides of the sheet-processing machine, the sheet has to be decelerated by the conveyor belt. After the arrival of the sheet, it does not have to be caused to buckle or bulge by the negative pressure acting on the conveyor belt, but should still, in some circumstances, be driven to a slight extent against the front guides in order to prevent a rebound.

Also, during the foregoing Phases 1 and 2, accelerating forces have to be transmitted to the sheet.

A conveying device of the general type described in the introduction hereto has been disclosed by the published German Patent Document DE 44 42 629 C2. The disclosed device has a conveying table with a conveyor belt that is subjected to negative pressure via three suction chambers arranged behind one another. The three suction chambers are supplied with negative pressure by two separate blowers. A first (top) suction chamber receives the sheet from the sheet separator or singler, a second (central) suction chamber allows the sheet to be transported over the conveying table, and a third (bottom) suction chamber, finally, is supposed to stabilize the sheet in the feeder. The two separate negative-pressure supplies or suppliers (blowers) signify a comparatively high outlay. It is also disadvantageous that satisfactory functioning of the heretofore known conveying device can be assured only when no sheet slowdown or deceleration device is provided. If a sheet slowdown or deceleration device is used with the heretofore known conveying device, then either it is not possible for the sheet to be decelerated shortly prior to sheet arrival without slipping of the sheet or, after arrival thereof at the front guides, the sheet is pressed too strongly against the front guides and jolted, depending upon the negative-pressure level in the end region of the conveyor belt and upon the position thereof, respectively.

Because the task of transporting over the conveying table is performed, in the case of the heretofore known conveying device, by a long suction chamber, moreover, a risk exists of not being able to build up sufficient negative pressure therewith in order to retain or hold the sheets, when the conveying table is not fully covered. This shortcoming has an adverse effect predominantly in the case of the first and the last sheets which are transported, because, in those cases, the negative pressure is not built up sufficiently, so that those two sheets cannot be retained reliably.

In the case of another device of the general type described in the introduction hereto, which has been disclosed in the published German Patent Document DE 197 28 056 A1, there is provided a suction-belt feeding table formed with a multiplicity of mutually independently actuatable suction chambers arranged behind one another. Although the negative pressure can be adapted to the situation at the respective location of the suction or conveyor belt, the separate activation of the large number of suction chambers nevertheless signifies high outlay and costs in terms of production and operation and in terms of controlling the machine.

Despite the high outlay, it is also the case with this heretofore known device under discussion, that it is not possible, when using a sheet decelerating or slow-down device, either to decelerate the sheet shortly prior to arrival or to prevent the sheet, following the arrival thereof, from being pressed against the front guides and compressed to an extent which is excessive, depending upon the negative-pressure level in the end region of the conveyor belt and upon the position thereof, respectively.

SUMMARY OF THE INVENTION

It is accordingly an object of the invention to provide a device for conveying a stream of sheets from a sheet pile to a sheet-processing machine, while avoiding the high outlay which has been involved hitherto for supplying negative pressure to the provided suction chambers, by taking suitable measures for supplying each individual suction chamber in an optimum manner with negative pressure.

With the foregoing and other objects in view, there is provided, in accordance with one aspect of the invention, a device for conveying an imbricated stream of sheets from a sheet pile to a sheet-processing machine, comprising a conveying table provided with at least one revolvingly drivable, air-permeable conveyor belt, the belt having a top strand with an underside slidable over the conveying table, and a plurality of suction chambers arranged behind one another for subjecting the conveyor belt to negative pressure, so that the conveyed sheets are retained on the conveyor belt until they are transferrable to the sheet-processing machine, and further comprising a common negative-pressure supply provided for negative-pressure activation of all of the suction chambers, and at least one throttle via which the suction chambers, respectively, are pneumatically connected to the common negative-pressure supply.

In accordance with other features of the invention, the suction chambers are arranged in the conveying table between a runner board for guiding the conveyor belt, and a continuous bottom partition spaced apart from the runner board, the suction chambers being formed by spacer cross-pieces located between the partition and the runner board, the at least one throttle being formed as throttle bores in the partition in a manner that at least one throttle bore, respectively, is assigned to each individual suction chamber.

In accordance with a further feature of the invention, a common negative-pressure supply chamber is disposed between the common negative-pressure supply and the individual suction chambers, and the throttle forms the pneumatic connection from the common negative-pressure supply chamber to the individual suction chambers.

In accordance with an added feature of the invention, the common negative-pressure supply chamber has a relatively large volume in comparison with the individual suction chambers.

In accordance with an additional feature of the invention, the common negative-pressure supply chamber is disposed beneath the conveying table and directly adjacent to the individual suction chambers, so that the continuous bottom partition of the suction chambers simultaneously constitutes a partition wall for the adjacent common negative-pressure supply chamber, the throttle bores forming the pneumatic connection between the individual suction chambers and the common negative-pressure supply chamber.

In accordance with another aspect of the invention, there is provided a device for conveying, more particularly by clock control, an imbricated stream of sheets from a sheet pile to a sheet-processing machine, comprising a conveying table provided with at least one revolvingly drivable, air-permeable conveyor belt, the belt having a top strand with an underside slidable over the conveying table, and a plurality of suction chambers arranged behind one another for subjecting the conveyor belt to negative pressure, so that the conveyed sheets are retained on the conveyor belt until they are transferrable to the sheet-processing machine, and further comprising a common negative-pressure supply provided for negative-pressure activation of all of the suction chambers, the supply, via at least one valve-controlled negative-pressure line, respectively, being in pneumatic operative connection with the suction chambers.

In accordance with yet another feature of the invention, the conveyor belt, over the length of the conveying table, extends over three suction-chamber regions arranged behind one another and being of different length, including a first suction-chamber region located adjacent to the sheet pile, a third suction-chamber region located adjacent to the sheet-processing machine, both the first and the third regions having a comparatively small length and a correspondingly small chamber volume, and a second suction-chamber region located between the first and the third regions, the second region extending over a comparatively great length and having a correspondingly large chamber volume, a plurality of the negative-pressure lines being controllable so that required negative pressures of the three suction-chamber regions are in the same ratio to one another as surfaces of the suction-chamber regions, which act to retain the sheet in the three regions.

In accordance with yet a further feature of the invention, the conveying device further comprises bypass valves arranged in the negative-pressure lines for adjusting at least one of the required and a desired ratio, respectively, of the negative pressures of the suction-chamber regions.

In accordance with yet an added feature of the invention, the conveying device further comprises two parallel negative-pressure lines provided for the third suction-chamber region located adjacent to the sheet-processing machine, the two parallel lines starting from a common negative-pressure supply chamber which is in pneumatic operative connection with the common negative-pressure supply, the two parallel negative-pressure lines, respectively, having a bypass valve and opening into a further valve which is switchable back and forth between the two parallel negative-pressure lines during the sheet-conveying cycle, the further valve having an outlet pneumatically connected to the third suction-chamber region.

In accordance with yet an additional aspect of the invention, there is provided a device for conveying, in particular by clock control, a stream of sheets from a sheet pile to a sheet-processing machine, comprising a conveying table provided with at least one revolvingly drivable, air-permeable conveyor belt, the belt having a top strand with an underside slidable over the conveying table, and a plurality of suction chambers arranged behind one another for subjecting the conveyor belt to negative pressure, so that the conveyed sheets are retained on the conveyor belt until they are transferrable to the sheet-processing machine, and further comprising respective negative-pressure supplies provided for negative-pressure activation of the suction chambers, respectively, the negative-pressure supplies, respectively, being in pneumatic operative connection with the respective suction chambers via a respective negative-pressure line.

In accordance with another feature of the invention, the conveying device further comprises a rotary valve connected between a respective negative-pressure supply and one of the suction chambers.

In accordance with a further feature of the invention, the rotary valve is drivable in time with the sheet-processing machine.

In accordance with an added feature of the invention, the rotary valve serves for providing three different pressure levels.

In accordance with a concomitant feature of the invention, the rotary valve serves for running through four phases with the three different pressure levels, during a machine cycle.

One alternative embodiment of the invention is suitable, in particular, for conveying tables, when the operation of transporting sheets is performed by a suction chamber with a multiplicity of suction-chamber regions arranged behind one another. All of these suction-chamber regions may be supplied from a common pressure-supply chamber wherein the desired pressure prevails without any occurrence of the aforedescribed deficiencies in negative pressure. Particular importance is given here to the throttles according to the invention, via which the individual suction chambers are connected to the common negative-pressure supply. The throttles make it possible, even with the conveying table only partially covered, for the necessary supply pressure to be established in the already covered suction-chamber region. This is because, as a result of the throttling action, so little inappropriately flowing air is produced in the open suction-chamber regions that the pressure in the negative-pressure supply drops only to a slight extent. This makes it possible to use just one negative-pressure supply for all of the suction-chamber regions.

A similarly advantageous effect is achieved by an alternative embodiment of the invention wherein, instead of throttles, valve-controlled negative-pressure lines are provided, by which the common negative-pressure supply is connected to the individual suction chambers and via which it is possible to adjust the different negative pressures in the different chambers.

This allows sheet transport over a plurality of three, for example, suction chambers which are arranged behind one another, and are supplied precisely with the negative pressures, so that the sheets, on the one hand, are always reliably retained but, on the other hand, are also not subjected to a higher negative pressure than is necessary.

The lowermost or final suction chamber is preferably clock-controlled, in order that the sheet can be decelerated and fed reliably and, nevertheless, is not compressed.

Other features which are considered as characteristic for the invention are set forth in the appended claims.

Although the invention is illustrated and described herein as embodied in a device for conveying a stream of sheets from a sheet pile to a sheet-processing machine, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, wherein:

DESCRIPTION OF THE PREFERRED EMBODIMENTS

Figure 1:
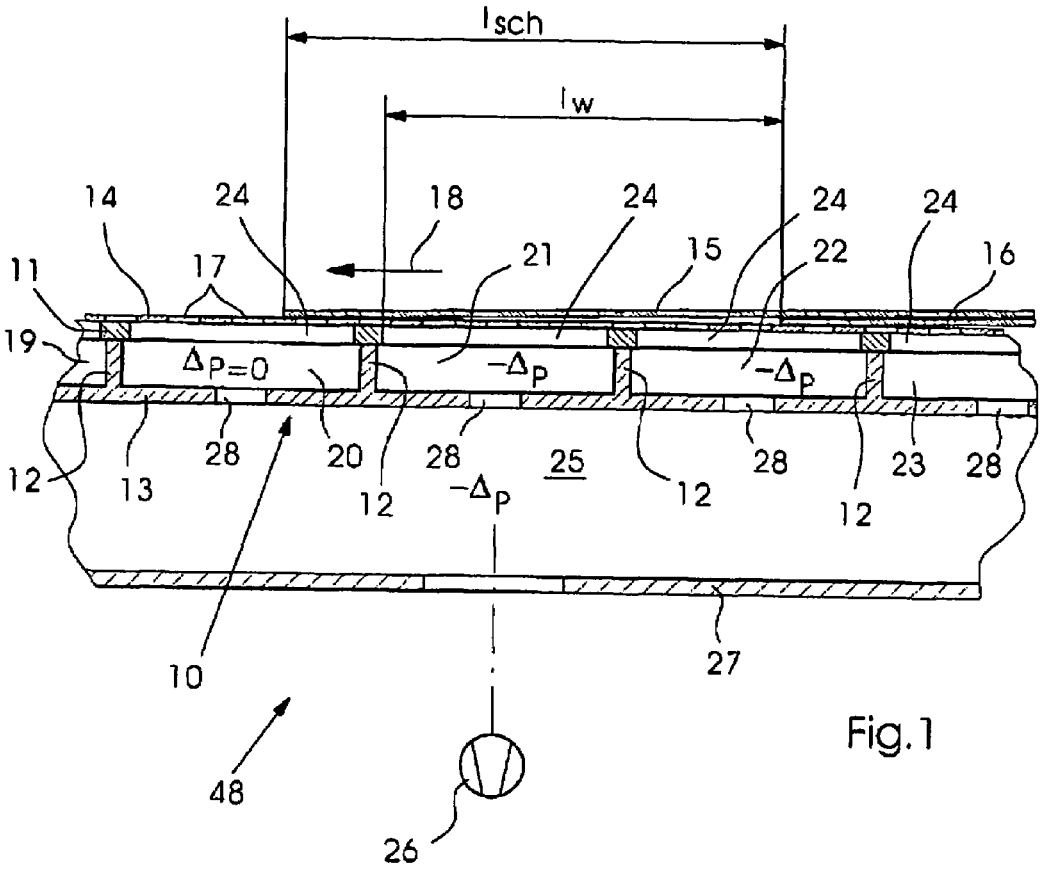
FIG. 1 is a fragmentary diagrammatic vertical, longitudinal sectional view of an embodiment of a conveying table for a sheet-processing machine, wherein suction-chamber regions, respectively, are connected via throttles to a common negative-pressure supply.

Referring now to the drawings and, first, particularly to FIG. 1 thereof, there is shown therein a conveying table, overall identified by reference numeral 10, of a feeder for a sheet-processing machine, e.g., a printing machine. The conveying table 10 mainly includes a top runner board 11 and a bottom continuous intermediate wall or partition 13, which is spaced apart from the runner board 11 by vertical intermediate crosspieces 12. A fragmentarily illustrated, endlessly circulating conveyor belt 14, conventionally referred to as a "suction belt", for sheets 15 and 16 to be transported, slides over the runner board 11 of the conveying table 10, the conveyor belt 14 having numerous suction bores 17 arranged behind one another at regular intervals. The travel direction of the conveyor belt, and thus the conveying direction of the sheets 15 and 16, is represented by an arrow 18.

Due to the aforementioned intermediate crosspieces 12, the space between the runner board 11 and the partition or intermediate wall 13 is subdivided into a multiplicity of individual so-called suction-chamber regions, five of which are visible in FIG. 1 and are identified by reference numerals 19 to 23. The suction-chamber regions 19 to 23 are constructed open in upward direction, i.e., in the direction towards the conveyor belt 14. Openings 24 of comparatively large surface area are provided.

The underside of the conveying table 10 is adjoined directly by a negative-pressure supply chamber 25 which has a comparatively large volume in relation to the volumes of the individual suction-chamber regions 19 to 23, and is connected to a suitable negative-pressure supply 26, such as a blower, for example, and has dimensions which are determined, on the one hand, by a terminating wall 27 and, on the other hand, by the aforementioned common bottom intermediate wall or partition 13 of the suction-chamber regions 19 to 23. Between the negative-pressure supply chamber 25, on the one hand, which is common to all the suction-chamber regions 19 to 23, as is also the negative-pressure supply 26, and the individual suction-chamber regions 19 to 23, on the other hand, a pneumatic connection is effected, by respective throttle bores 28. Thus, the same negative pressure $\Delta p$, as shown in FIG. 1, prevails in the individual suction-chamber regions 19 to 23 as in the negative-pressure supply chamber 25, when the suction chambers of the regions 19 to 23 are covered by sheets which are to be transported. In the exemplary embodiment illustrated in FIG. 1, only the suction-chamber regions 21, 22 and 23, but not the suction-chamber regions 19 and 20, are fully covered by the sheets 15 and 16. Consequently, only the negative pressure necessary for sheet transporting prevails in the suction-chamber regions 21 to 23.

It is also clear that the sheet transport depicted in FIG. 1 is so-called imbricated sheet transport, i.e., during transport (by the conveyor belt 14), the sheets overlap partially. In FIG. 1, the imbricated length or overlap length $l_{sch}$ of the two overlapping sheets 15 and 16 is represented. The individual suction-chamber regions 19 to 23 are thus capable of exerting suction action and retaining force therewith on the part of the respective transported sheet, only insofar as that sheet does not have a following sheet gripped therebeneath. For the first sheet 15, in this case, consequently, the effective length of the suction-chamber regions 21 and 22 is $l_w$.

The instant one of the individual suction-chamber regions 19 to 23 is thus covered by one sheet (and two overlapping sheets, respectively), the negative pressure therein begins to build up. An important factor here is for the flow cross section of the throttles to be small, in order to reduce the amount of inappropriately flowing air. Due to the small flow cross sections of the throttle bores 28, however, the volume of the individual suction-chamber regions 19 to 23 should also be comparatively small, so that the negative pressure can build up sufficiently quickly.

From this same standpoint, as seen in FIG. 1, the aforementioned spatial proximity of the suction-chamber regions 19 to 23, on the one hand, and the negative-pressure supply chamber 25, on the other hand, is very advantageous.

Figure 2:
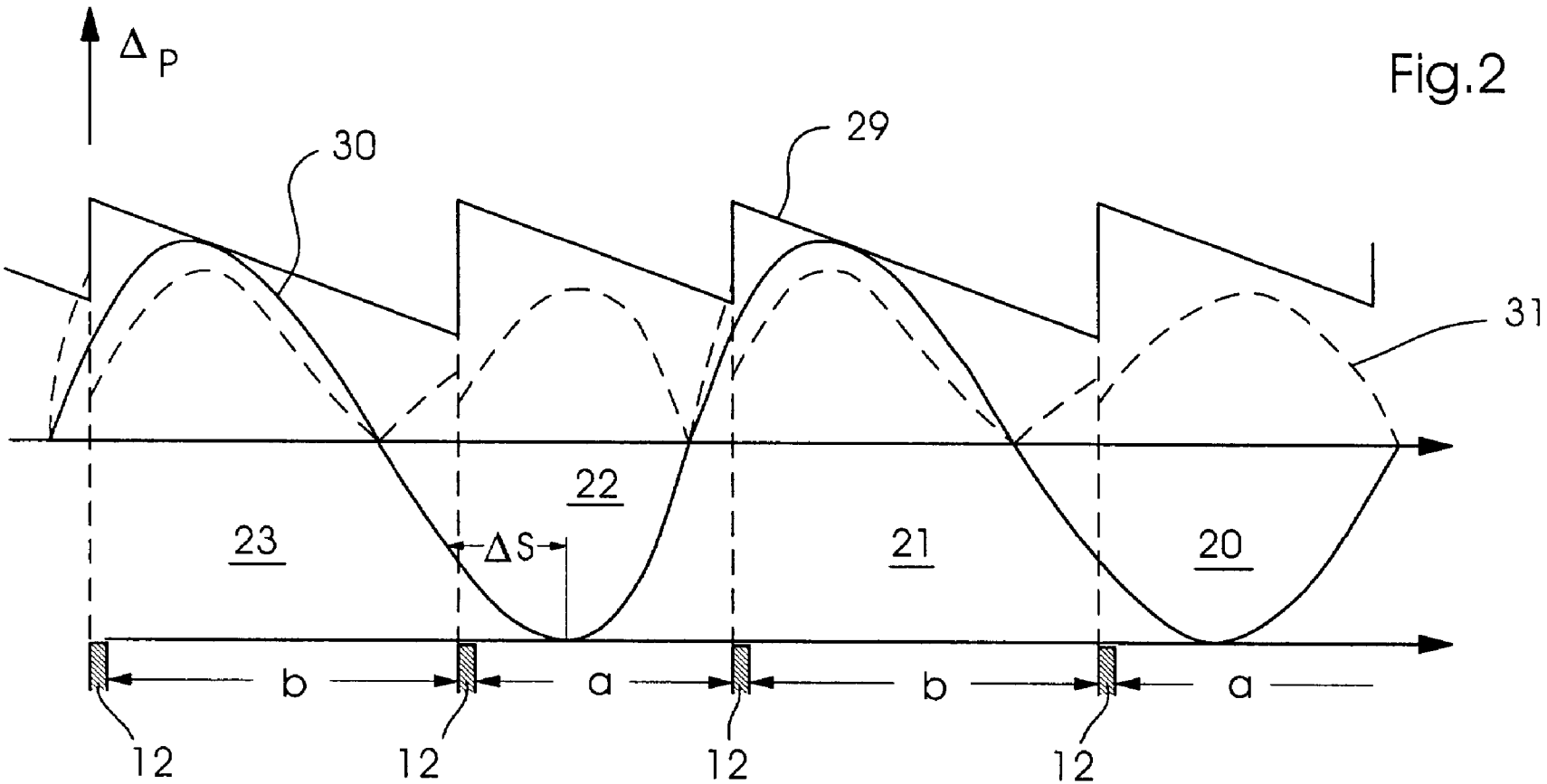
FIG. 2 is a plot diagram of the profile of the effective chamber length available for transport and, at constant negative pressure, the possible retaining force, respectively, in the case of the arrangement according to FIG. 1, in individual successive suction-chamber regions, and the profile of the relationship between the acceleration (absolute) and the effective chamber length and the sheet acceleration and deceleration, repectively, plotted in each case over the sheet transport path along the conveying table.

If the so-called sheet slow-down device or decelerator is provided, (note, in particular, FIG. 2 in this regard) the sheets are periodically decelerated and accelerated during the sheet transport. The suction-chamber boundaries, marked by the intermediate crosspieces 12, are coordinated with the acceleration profile so that the required negative pressure, even with the conveying table 10 partly not covered by sheets, need be only comparatively low. The position of the suction-chamber boundaries 12 is thus selected so that a respectively optimum effective length of the suction-chamber regions 19 to 23 is achieved throughout the accelerating and/or decelerating operation during the sheet transport. From FIG. 2, it is believed to be clearly shown that this is the case both for the acceleration and deceleration maxima and for the acceleration and deceleration values between the two extreme values. In this case, a sawtooth-shaped curve 29 designates the profile of the respectively effective chamber length for the first sheet. When one chamber is fully covered respectively, the length a and b thereof, respectively, is added as the effective chamber length. An undulating or wave-shaped curve 30 illustrates the acceleration and deceleration, respectively, which each transported sheet 15, 16, for example, in FIG. 1, experiences on the transport path thereof. A further curve 31, shown in broken lines, designates the relationship of the respective (absolute) acceleration values to the respectively effective length of the suction-chamber regions.

A special feature here is thus that the boundaries of the suction-chamber regions (the intermediate crosspieces 12) are selected so that the maximum values of the curve 31 remain as small as possible, because the required negative pressure may then be minimal. The diagram according to FIG. 2 also clearly shows that, in the region of the minima of the acceleration curve 30 (wherein acceleration and deceleration values are lower than in the region of the curve maxima), a smaller effective length a of the respective suction-chamber regions is sufficient. In addition, in the case of the effective lengths a and b, respectively, of the respective suction-chamber regions selected, the time required for building up the negative pressure in the respective suction-chamber region following coverage by sheets has also been taken into account.

Figure 3:
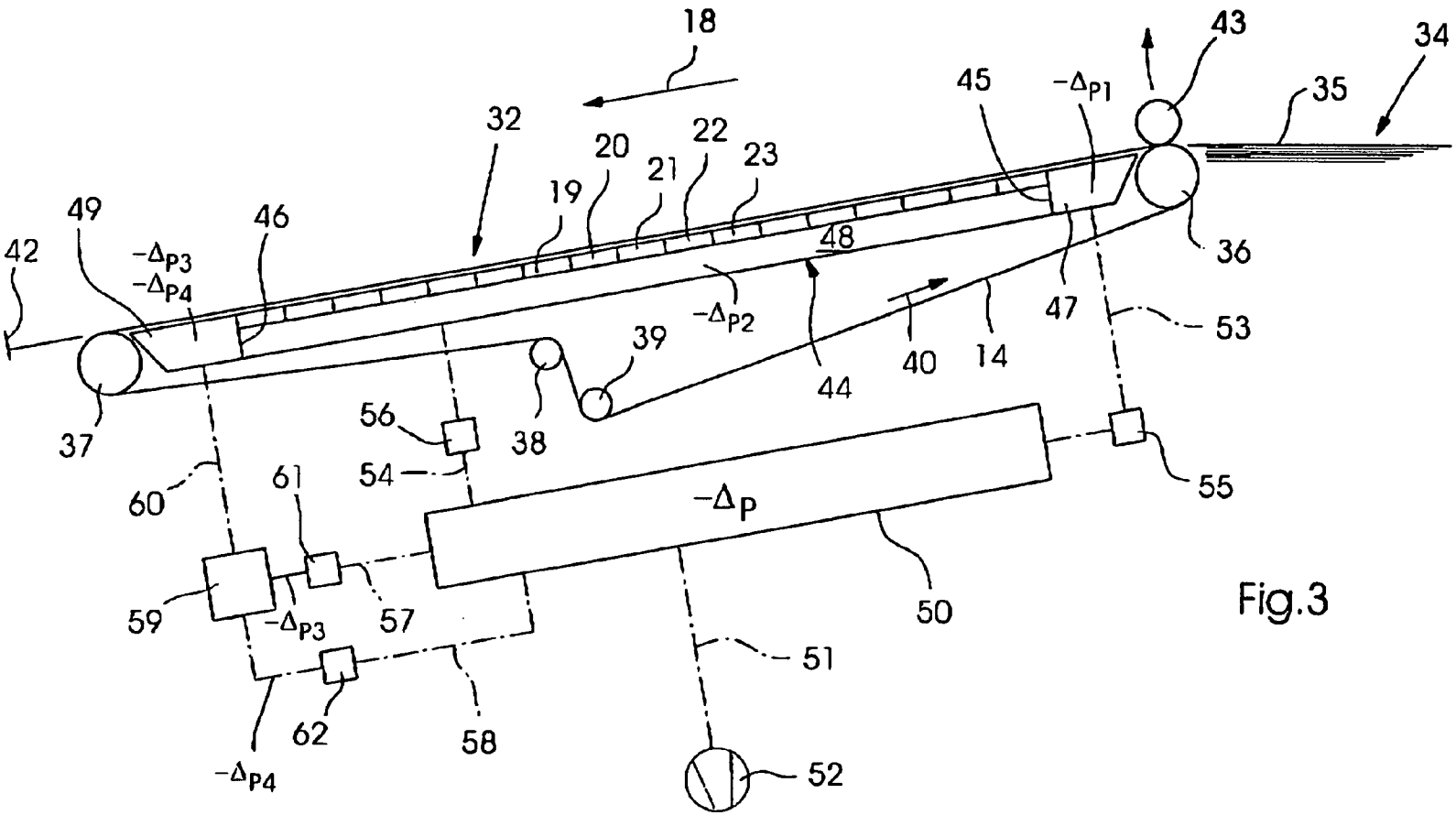
FIG. 3 is a diagrammatic side elevational view of an embodiment of a conveying table differing from that of FIG. 1 but likewise having a common negative-pressure supply for all the suction chambers, the central region thereof being configurable as in FIG. 1.

In the embodiment according to FIG. 3, a conveying table, overall identified by reference numeral 32, has a surface over which there is guided an endlessly revolving conveyor belt 14 for sheets 35 to be processed, which have been removed from a sheet pile 34. At the two ends of the conveying table 32, the conveyor belt 14 is deflected by deflecting rollers 36 and 37 and driven, respectively, and tautened by tensioning rollers 38 and 39. The travel or running direction of the conveyor belt 14 is represented by an arrow 40. The sheets 35 are thus conveyed in the direction of the arrow 18 over the surface of the conveying table 32 until they come into abutment with front guides or lays 42 of a non-illustrated further-processing machine, e.g., a printing machine. The conveying table 32 in FIG. 3, starting from the sheet pile 44, declines from the top. The sheet transport takes place by clock control, for which purpose a timed roller 43 is disposed above the deflection roller 36.

The conveyor belt 14 is formed with a multiplicity of suction bores, although they are not shown in FIG. 3. Disposed on the underside of the conveying table 32 and extending over the entire length of the latter is a suction box 44, which is subdivided into three suction chambers 47, 48 and 49 by intermediate walls or partitions 45 and 46.

Different negative pressures $-\Delta_{p1}$ to $-\Delta_{p4}$ may be built up in the suction chambers 47, 48 and 49, so as to act via the suction bores formed in the conveyor belt 14 for subjecting sheets transported over the conveying table 32 by the conveyor belt 14 to correspondingly different retaining forces. A negative-pressure supply chamber 50 is provided in order to generate these negative pressures, the chamber 50 being connected pneumatically to a suitable negative-pressure supply 52, e.g., a blower, via a negative-pressure line 51. A uniform negative pressure $-\Delta_p$ prevails in the negative-pressure supply chamber 50. The negative-pressure supply chamber 50 is connected pneumatically to the first suction chamber 47 by a first negative-pressure line 53, and to the second suction chamber 48 by a second negative-pressure line 54. A respective bypass valve 55, 56 is arranged in each of the two negative-pressure lines 53 and 54. The third suction chamber 49 is connected to the negative-pressure supply chamber 50 by two parallel negative-pressure lines 57 and 58, which connect with a (common) third negative-pressure line 60 via a switching or pilot valve 59. A respective bypass valve 61, 62 is arranged in the parallel negative-pressure lines 57 and 58, respectively. The switching valve 59, which may, for example, be a rotary valve, switches back and forth alternately, during the conveying cycle of the sheets, between the parallel negative-pressure lines 57 and 58 and the respective bypass valves 61 and 62.

A further special feature in the embodiment according to FIG. 3 is that the second suction chamber 48 is considerably longer than the first suction chamber 47 and the third suction chamber 49 and is thus provided with a considerably larger volume, and that the negative-pressure lines 53, 54, 57 and 60 are controlled by the bypass valves 55, 56 and 61 so that the required negative pressures of the three suction chambers 47, 48 and 49 have the same ratio to one another as those surfaces of the suction chambers 47, 48 and 49 which act to retain the sheet in the three regions.

The first suction chamber 47, which is arranged directly downstream of the timed roller 43, as viewed in the sheet travel direction 18, is constructed so as to be precisely of such length that, when the timed roller 43 opens or disengages, the suction chamber is, in fact, then just fully covered by the sheet 35, for example, which is just being released by the timed roller 43.

The first suction chamber 47 is supplied with the negative pressure $-\Delta_{p1}$ which is required for reliably retaining the sheet on this first section of the conveying table 32 and the conveyor belt 14, respectively. The thereafter following second suction chamber 48, constructed as shown in FIG. 1, is responsible for the transport of the sheet over the conveying table 32. During imbricated or overlapping operation, the sheets are retained here over the entire imbricated length. The negative pressure $-\Delta_{p2}$ must and may, respectively, be only just large enough here for it to be possible for the acceleration and deceleration forces of the sheet slowdown or decelerator device to be transmitted to the sheets. A higher negative pressure, for example, would increase the friction between the conveyor belt 14 and the conveying table 32, due to which there would be an undesirable increase in the drive power which would have to be provided for the conveyor belt 14, and in the wear thereof.

Shortly prior to the arrival of the sheet at the front guides 42, the sheet has to be decelerated by the end region of the conveyor belt 14 thereat (sheet arrival at minimal speed). Because the conveyor belt 14 cannot extend to as far as the front guides 42, and the bordering preceding part of the conveyor belt 14, which is counter to the conveying direction 18, is cut off by the following sheet, the region for decelerating the sheet is considerably shorter than the imbricated length. Allowances are made for this situation by the third suction chamber 49, in that a larger negative pressure $-\Delta_{p3}$ prevails here than in the preceding, second suction chamber 48. Following the sheet arrival, this higher negative pressure $-\Delta_{p3}$, nevertheless, would result in the fed sheet being compressed. As a result, upon sheet arrival, the negative pressure in the third suction chamber 49 is reduced (to $-\Delta_{p4}$) to such an extent that the undesired compression effect cannot take place. A small negative pressure $-\Delta_{p4}$ can and should nevertheless be maintained in order to prevent rebounding of the sheet. The pressure level $-\Delta_{p4}$ is thus adjusted to correspondingly by the operator. If the third suction chamber 49 is cut off from the following sheet, the negative pressure in the third suction chamber 49 may be increased again to the original level $-\Delta_{p3}$.

The active surfaces which have the task of retaining the sheet in the three suction chambers 47, 48 and 49 are in a fixed ratio to one another, as are correspondingly also the required negative pressures $-\Delta_{p1}$ to $-\Delta_{p3}$. Because the different pressure levels of the three suction chambers 47, 48 and 49 can be adjusted via the bypass valves 55, 56 and 61, respectively, it is possible for all three suction chambers 47, 48 and 49 to be subjected to the action of a common negative-pressure supply 52 via a common negative-pressure supply chamber 50. The ratio of the negative pressures prevailing in the suction chambers 47, 48 and 49 thus remains unchanged even in the case of a change in the general negative-pressure level (in the common negative-pressure supply 52 and/or in the common negative-pressure supply chamber 50).

The aforementioned switching valve 59 has the function, during the conveying cycle of the sheets, of lowering the negative-pressure level in the third suction chamber 49, the pressure being pre-set to the deceleration of the sheets which takes place in the suction chamber, to a (manually selectable) lower negative-pressure level, in order to ensure that the sheets are fed satisfactorily to the front guides 42 (without subsequent compression). The special feature here is thus that it is not just the conveying of the sheet as such which takes place by clock control; rather, the negative pressure $-\Delta_{p3}$ and $-\Delta_{p4}$, respectively, in the third suction chamber 49 are also clock-controlled (back and forth) synchronously therewith.

Figure 4:
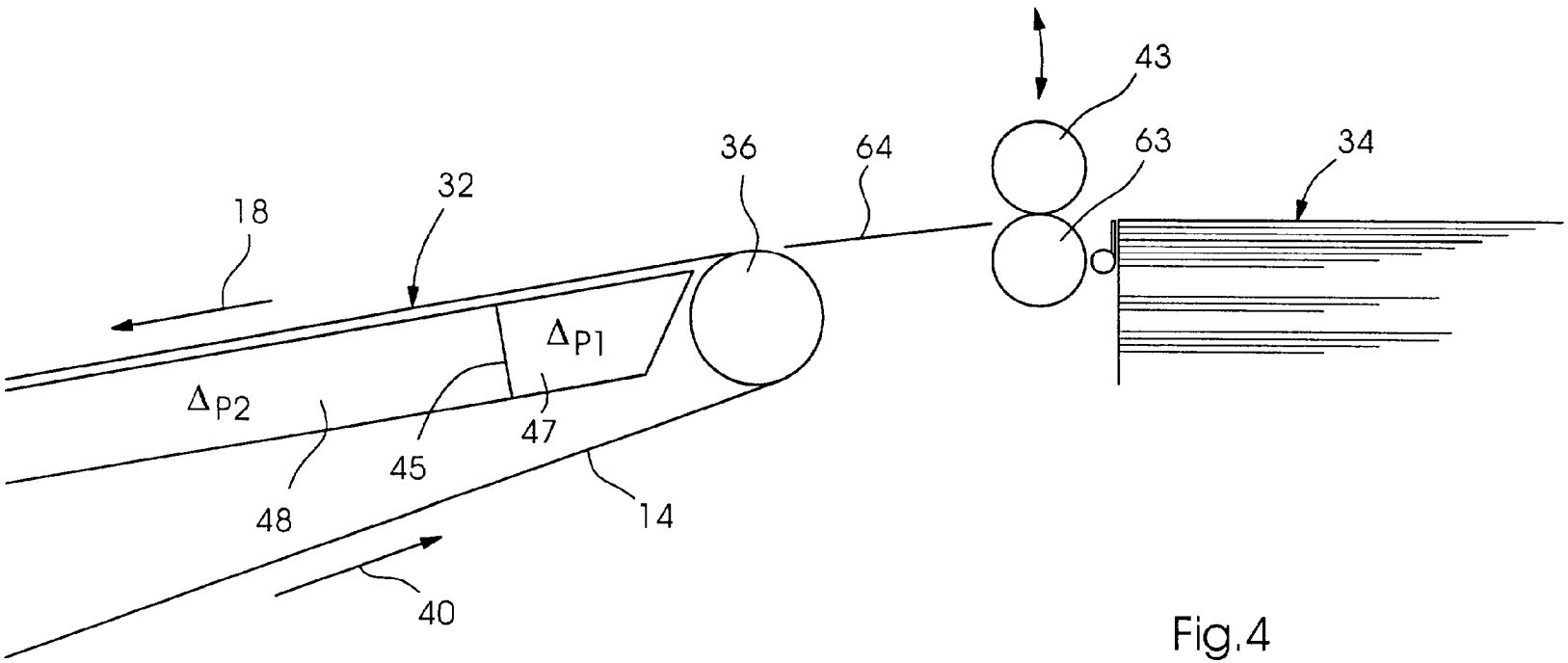
FIG. 4 is an enlarged fragmentary view of FIG. 3, showing an embodiment which is somewhat modified over that of FIG. 3 in the region between the conveying table and the sheet pile.

The alternative embodiment according to FIG. 4 mainly differs from the embodiment according to FIG. 3 only in that, in the embodiment of FIG. 4, rather than interacting or cooperating directly with the deflecting roller 36, the timed roller 43 cooperates with an (additional) infeed roller 63 which serves for removing the individual sheets from the sheet pile 34 and feeding them to the conveying table 32. A special feature is that a conveying-table region 64, which does not have a conveyor belt available thereto, extends between the timed roller 43 and the infeed roller 63, on the one hand, and the conveyor belt 14 and the actual conveying table 32, respectively, on the other hand. The resulting spacing or spaced distance between the pair of rollers 43 and 63, on the one hand, and the conveyor belt of the actual conveying table 32, on the other hand, is bridged by the conveying capacity of the infeed roller 63 in conjunction with the timed roller 43 and the conveying-table region 64.

Figure 5:
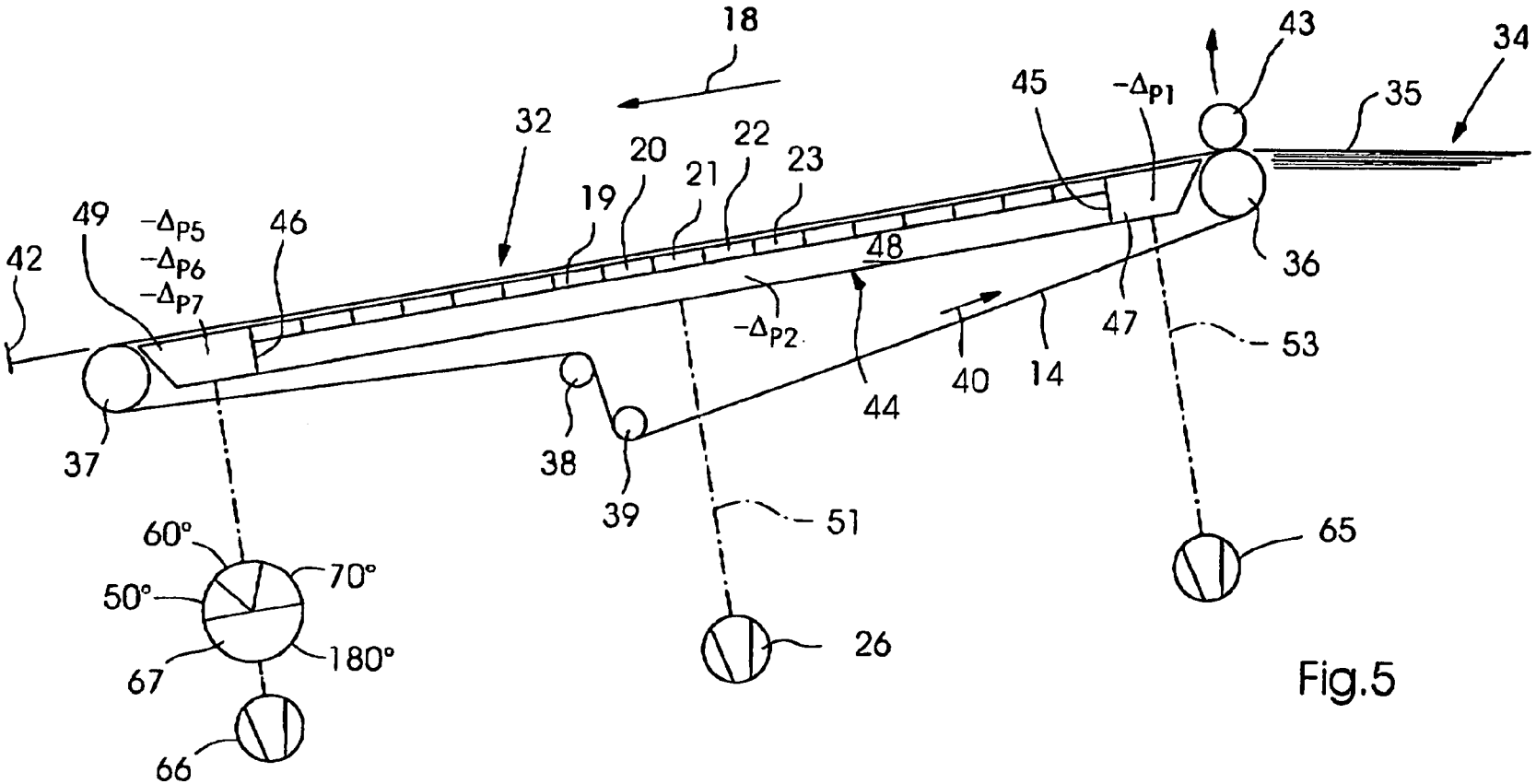
FIG. 5 is a view similar to that of FIG. 3, but showing an embodiment with three negative-pressure supplies.

In an embodiment according to FIG. 5, provision is made for all the suction chambers 47, 48 and 49 to have a respective dedicated negative-pressure supply 65, 26, 66 assigned thereto. In this regard, the negative-pressure supply 26 remains assigned to the second suction chamber. The negative-pressure supply 65 is assigned to the first suction chamber 47. The negative-pressure supply 66 is assigned to the third suction chamber 49, a rotary valve 67, which can be driven in time with the sheet-processing machine, being interposed between the suction chamber 49 and the negative-pressure supply 66. Depending upon the machine angle of the sheet-processing machine, the rotary valve 67 supplies the suction chamber 49 with three negative pressures which are at different levels and preferably prevail at the suction chamber 49 during four phases of respectively different length. In this regard, a preferred exemplary embodiment provides that, after the uppermost sheet has been gripped by non-illustrated pregrippers, the prevailing pressure level $-\Delta_{p5}$ is high and, over a machine angle of approximately 180°, is retained at this level until a following sheet 15 has reached the front guides 42. A mean or average pressure level $-\Delta_{p6}$ is then established in the suction chamber 49, this pressure level being active over a machine angle of approximately 50° in order to retain the sheets 15 on the front guides 42. Subsequent thereto, a low pressure level $-\Delta_{p7}$ is established in the suction chamber 49 in order that the sheet 15 may be relieved of tension without being hindered too greatly by retaining forces of the suction belts. The pressure level $-\Delta_{p7}$ prevails over a machine angle of approximately 60°. Over a machine angle of approximately 70°, i.e., until the end of the cycle, the mean pressure level $-\Delta_{p6}$ is re-established. In this regard, the following sheet 16 has covered the suction chamber 49. After a machine angle of approximately 70° has been traversed, the top sheet 15 is gripped by the pregrippers. Air that is being sucked through no longer has any adverse affect upon the top sheet 15, so that the high pressure level $-\Delta_{p5}$ may be established for reliable transport of the sheet 16 into engagement with the front guides 42.

We claim:

1. A device for conveying an imbricated stream of sheets from a sheet pile to a sheet-processing machine, comprising:

a conveying table including a top runner board and a continuous bottom partition spaced apart from said top runner board by spacer crosspieces located between said partition and said runner board;

at least one revolvingly drivable, air-permeable conveyor belt, said belt having a top strand with an underside slidable over said conveying table and guided by said top runner board;

three suction chambers disposed behind one another and being of different length, said suction chambers including a first suction chamber located adjacent the sheet pile, a third suction chamber located adjacent the sheet-processing machine, each of said first and third suction chambers having a length and a corresponding chamber volume, and a second suction chamber located between said first and third suction chambers, said second suction chamber extending over a length greater than said length of each of said first and third suction chambers and having a corresponding chamber volume larger than said volume of each of said first and third suction chambers, said second suction chamber having a plurality of suction-chamber regions disposed behind one another, said suction-chamber regions and said suction chambers being formed in said conveying table between said runner board and said partition by said spacer crosspieces;

a common negative-pressure supply provided for negative-pressure activation of all of said suction chambers; and a plurality of throttles formed in said partition, each of said suction-chamber regions being pneumatically connected to said common negative-pressure supply via a respective throttle.

2. The conveying device according to claim 1, further comprising a common negative-pressure supply chamber disposed between said common negative-pressure supply and said individual suction-chamber regions, said throttles forming a pneumatic connection from said common negative-pressure supply chamber to said individual suction-chamber regions.

3. The conveying device according to claim 2, wherein said common negative-pressure supply chamber has a larger volume than said individual suction-chamber regions.

4. The conveying device according to claim 1, wherein said common negative-pressure supply chamber is disposed beneath said conveying table and directly adjacent said individual suction-chamber regions, so that said continuous bottom partition of said suction-chamber regions simultaneously constitutes a partition wall for said adjacent common negative-pressure supply chamber, said throttles form a pneumatic connection between said individual suction-chamber regions and said common negative-pressure supply chamber.

5. The conveying device according to claim 1, further comprising at least one valve-controlled negative-pressure line, said common negative-pressure supply, via said at least one valve-controlled negative-pressure line, respectively, being in pneumatic operative connection with said suction chambers.

6. The conveying device according to claim 5, wherein a plurality of said negative-pressure lines are controllable so that required negative pressures of said three suction chambers are in the same ratio to one another as surfaces of said suction chambers, which act to retain the sheet in said three regions.

7. The conveying device according to claim 6, further comprising bypass valves arranged in said negative-pressure lines for adjusting at least one of a required and a desired ratio, respectively, of the negative pressures of said suction chambers.

8. The conveying device according to claim 6, further comprising two parallel negative-pressure lines provided for said third suction chamber located adjacent the sheet-processing machine, said two parallel lines starting from said common negative-pressure supply being in pneumatic operative connection with said common negative-pressure supply, said two parallel negative-pressure lines, respectively, having a bypass valve and opening into a further valve switchable back and forth between said two parallel negative-pressure lines during the sheet-conveying cycle, said further valve having an outlet pneumatically connected to said third suction chamber.

9. The conveying device according to claim 1, wherein said common negative-pressure supply is one of a plurality of negative-pressure supplies provided for negative-pressure activation of said suction chambers, respectively, said negative-pressure supplies, respectively, being in pneumatic operative connection with the respective suction chambers via a respective negative-pressure line.

10. The conveying device according to claim 9, further comprising a rotary valve connected between a respective negative-pressure supply and one of said suction chambers.

11. The conveying device according to claim 10, wherein said rotary valve is drivable in time with the sheet-processing machine.

12. The conveying device according to claim 10, wherein said rotary valve serves for providing three different pressure levels.

13. The conveying device according to claim 12, wherein said rotary valve serves for running through four phases with said three different pressure levels, during a machine cycle.

* * * * *